US005431336A

United States Patent [19]

Clee

[11] Patent Number: 5,431,336

[45] Date of Patent: Jul. 11, 1995

[54] CORNER BRACE FOR A TOTE BOX CONSTRUCTION

[75] Inventor: Michael Clee, Bradford, Canada

[73] Assignee: Pine Valley Packaging Limited, Concord, Canada

[21] Appl. No.: 246,204

[22] Filed: May 19, 1994

[51] Int. Cl.[6] ..... B65D 5/42

[52] U.S. Cl. ..... 229/199; 229/198; 229/918; 206/512

[58] Field of Search ..... 206/509, 512; 229/189, 229/198, 198.1, 199, 918, 919

[56] References Cited

U.S. PATENT DOCUMENTS

| | | | |
|---|---|---|---|
| 1,697,494 | 1/1929 | Cook | 229/189 X |
| 2,160,631 | 5/1939 | Woolsey | 206/512 X |
| 2,791,366 | 5/1957 | Geisler | 229/198.1 X |
| 2,859,905 | 11/1958 | Choate | 229/198.1 X |
| 3,760,465 | 9/1973 | Brennan | 229/198 X |
| 4,201,307 | 5/1980 | Malloy | 229/189 X |
| 4,278,196 | 7/1981 | Ford | 229/198.1 X |
| 4,619,365 | 10/1986 | Kelly et al. | 229/918 X |
| 5,036,979 | 8/1991 | Selz | 206/512 |
| 5,037,027 | 8/1991 | Nichols | 206/512 X |

FOREIGN PATENT DOCUMENTS

| | | | |
|---|---|---|---|
| 2804406 | 8/1979 | Germany | 229/918 |

*Primary Examiner*—Allan N. Shoap
*Assistant Examiner*—Christopher McDonald
*Attorney, Agent, or Firm*—Jeffrey T. Imai; Arne I. Fors; D. Doak Horne

[57] ABSTRACT

A corner brace for a tote box assembly, wherein the tote box assembly comprises a box portion foldable from a box blank having a bottom, two side walls, two end walls and four end flaps extending from the side walls. The end walls and end flaps bonded together and have apertures into which are receivable hand holds. Four rails each having a channel and is fitted over a top edge of each said side walls and end walls. Each corner brace comprises an outer panel for extending about a corner, an inner panel integrally extending inwardly from said outer panel presenting a stackable surface and a flap, and a fastener for fastening said corner braces to said side walls and end walls. The improvement comprises said inner panel sized to fit about and enclose an end region of said side rail and an end region of said end rail and said fastening means joins said inner panel to said outer panel below said rails, clamping said rails and walls together.

13 Claims, 5 Drawing Sheets

CORNER BRACE FOR A TOTE BOX CONSTRUCTION

FIELD OF INVENTION

This invention relates to a lockable corner brace for improving the efficiency of the manufacture of stackable tote boxes.

BACKGROUND OF THE INVENTION

Returnable/reusable containers for the transportation of goods is widely used. Such containers, or tote boxes, must have sufficient strength to be able to safely transport the goods stored therein without damage. These tote boxes are normally designed to be stackable with the corners reinforced to support such stacking. The corners of prior art tote boxes are normally reinforced permitting the tote boxes to sufficiently support the weight of upper layers of stacked tote boxes. Such tote boxes are described in U.S. Pat. No. 5,037,027.

These tote boxes usually have a rail for reinforcing the upper edge of the tote and have corner braces to secure the side rails together and to the side panels of the tote box. These corner braces are rivetted through the corner brace to sandwich the side braces to the side panels of the tote box.

The process of assembling a prior art tote box requires an average of six minutes of labor time in which to install the corner braces and rivet them to the tote box.

The tote boxes of the prior art construction are satisfactory. However, the present invention reduces the time for assembly of the tote box to approximately two minutes per unit without sustaining any significant loss in tote box strength.

SUMMARY OF THE INVENTION

The disadvantages of the prior art may be overcome by providing a corner brace which completes the assembly of a tote box in a reduced time period.

According to one aspect of the invention, there is provided a corner brace for a tote box assembly. The tote box assembly comprises a box portion foldable from a box blank having a bottom, two side walls, two end walls and four end flaps extending from the side walls. The end walls and end flaps bonded together and have apertures into which are receivable hand holds. Four rails each has a channel which complementarily fits over a top edge of each said side walls and end walls. Each corner brace comprises an outer panel for extending about a corner, an inner member integrally extending inwardly from said outer panel presenting a stackable surface, and a fastener for fastening said corner braces to said side walls and end walls. The improvement comprises said inner member sized to fit about and enclose an end of said side rail and an end of said end rail and said fastening means joins said inner member to said outer panel below said rails, clamping said rails and walls together.

According to another aspect of the invention, there is provided a corner brace wherein the fastener comprises a pin on one of the inner member or outer panel and an aperture for lockably receiving the pin on the other of the inner member or outer panel.

According to another aspect of the invention, there is provided a corner brace having a cone-shaped pin.

According to another aspect of the invention, there is provided a pin having a stem having a plurality of biased fins for lockably retaining a wall panel once the pin has passed therethrough.

According to another aspect of the invention, there is provided a pin having longitudinal slot for axially compressing said pin for inserting the pin through a pilot hole when in a compressed state and locking said pin therein when in an uncompressed state.

According to another aspect of the invention, there is provided a pin connected to said one of said member panel or outer panel by a flexible attachment.

DETAILED DESCRIPTION OF THE DRAWINGS

In drawings which illustrate embodiments of the invention,

DETAILED DESCRIPTION OF THE INVENTION

Figure 1:
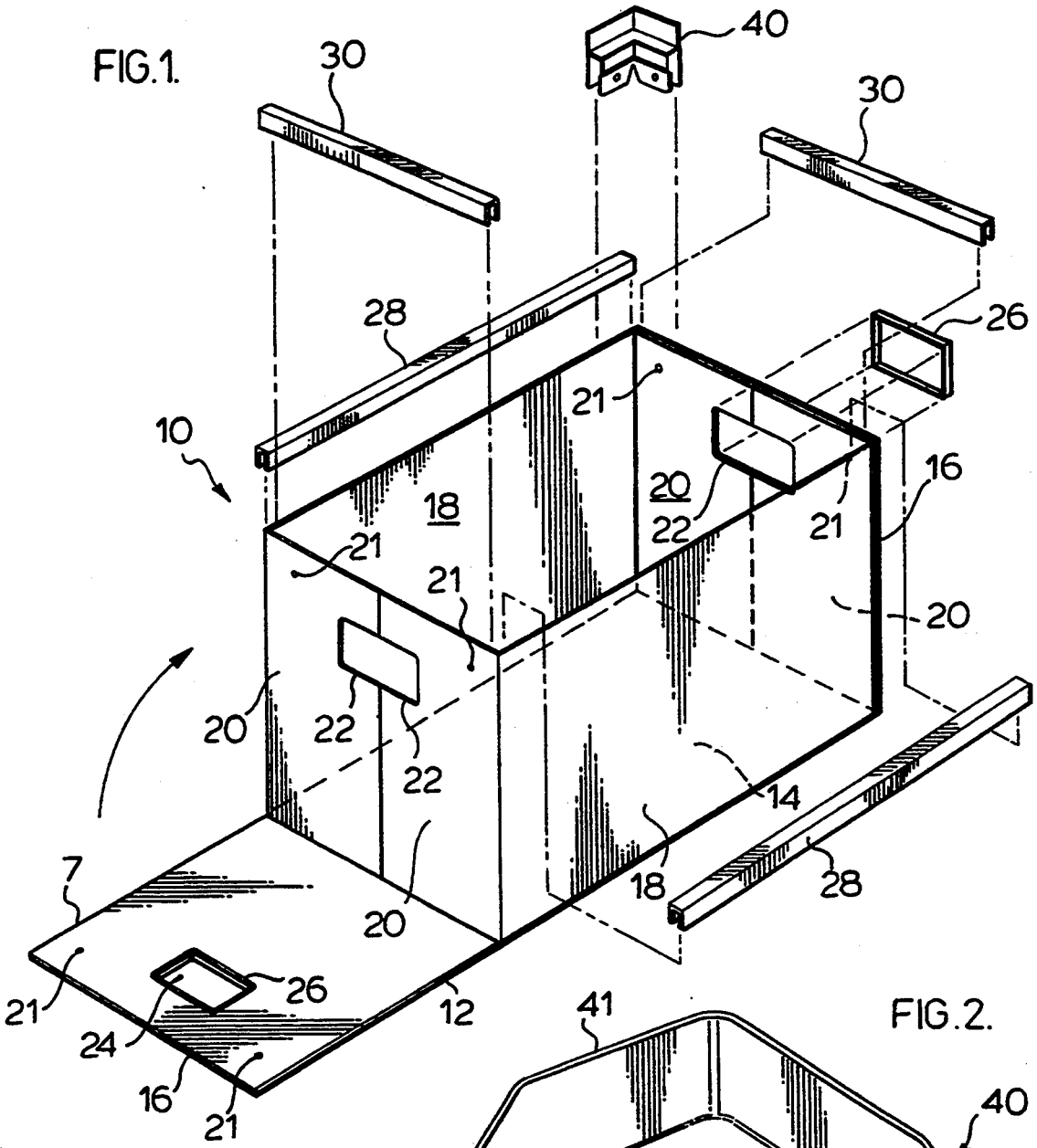
FIG. 1 is a perspective exploded view of the tote box incorporating the present invention.

Referring to FIG. 1, the tote box incorporating the present invention is generally illustrated. The tote box 10 generally comprises a box blank 12 which is stamped out or otherwise pre-cut from, preferably, corrugated plastic board. The blank 12 has a bottom 14, end panels 16, side panels 18 and end flaps 20. End flaps 20 have notches 22 cut therein. Pilot holes 21 are stamped in the end panels 16 and end flaps 20 which will align when the tote box 10 is folded for assembly.

End panels 16 have a handle opening 24 cut to align with notches 22 on end flaps 20 for presenting a hand hold. Hand holds 26, having a general outline of handle opening 24, is inserted therein for presenting a surface for lifting the tote box 10. Hand holds 26 can be made of plastic, aluminum or other suitable material.

Optionally, side panels 18 can also have apertures for presenting additional handle openings.

Tote box 10 has four reinforcement rails 28 and 30. The side rails 28 and end rails 30 have a channel for complementarily fitting with the side and end panels. In the illustrated embodiment, the channel is substantially inverted U-shaped wherein the width of the U-shaped channel is sized to receive the thickness of blank 12. End rail 30 has an inverted U-shaped channel which is slightly wider to receive two layers of blank 12.

Four corner braces 40 are used to secure the rails 28 and 30 onto the folded blank 12 to maintain the stability of tote box 10.

Figure 2:
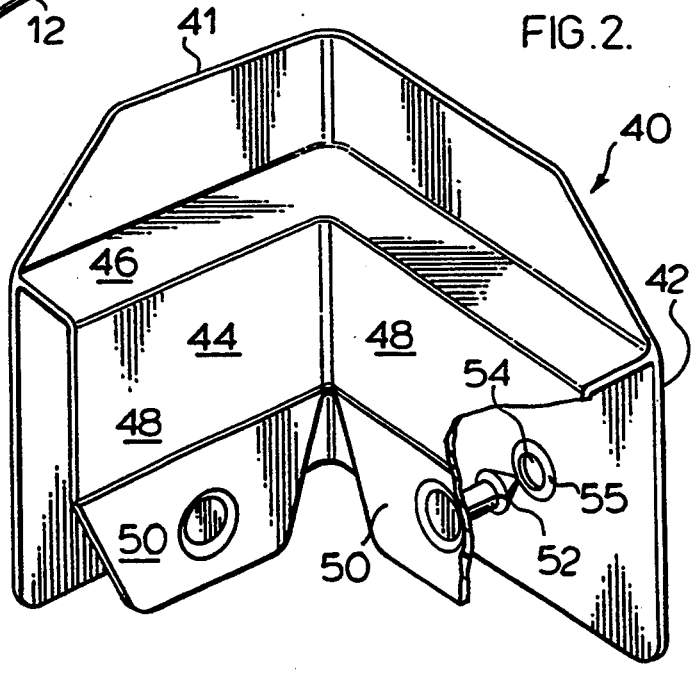
FIG. 2 is a perspective view of the corner brace of the present invention.
Figure 3:
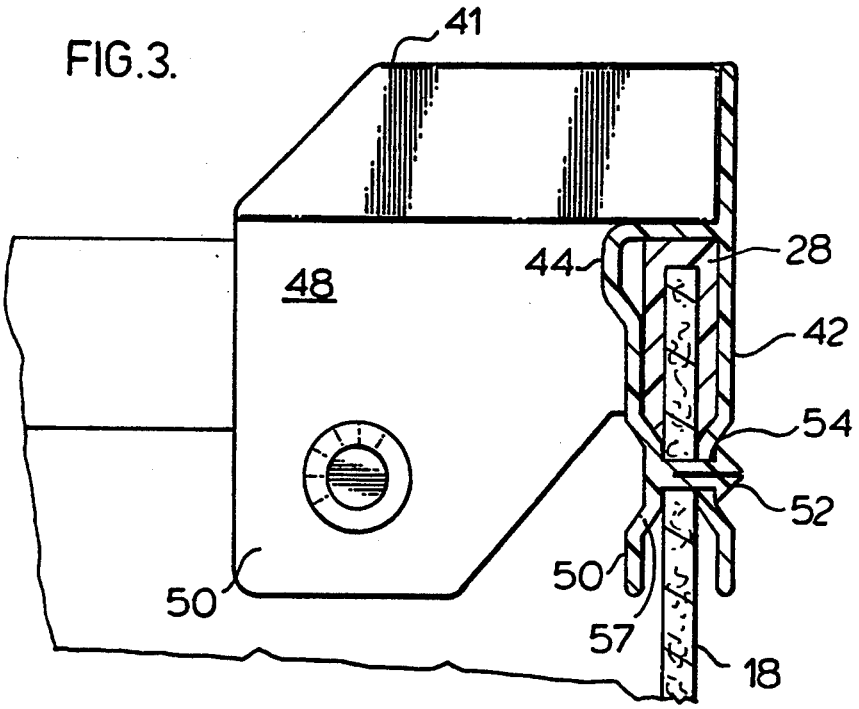
FIG. 3 is a side elevational view, partly in section, of the embodiment of FIG. 2.

Referring to FIG. 2, corner brace 40 is illustrated in greater detail. Corner brace 40 has an outer L-shaped panel 42, an inner panel 44 and an upper lip 41. Inner member 44 has a horizontal portion 46, a vertical portion 48 and a lower portion 50. Lower flap 50 has a fastener comprising pin 52 which extends from the inside of flap 50 toward aperture 54 on outer panel 42. Inner member 44 has a size which fits over the side rail 28 and end rail 30.

Preferably, aperture 54 has a riser 55 having a thickness approximating but slightly less than the thickness of a leg defining the U-shape of rails 28 and 30. Similarly, the inner face of flap 50 has a riser 57 having a thickness approximating but slightly less than the thickness of the opposite leg defining the U-shape of rails 28 and 30. The risers 55 and 57 improve the clamping ability of the corner brace 40.

Pin 52 has a conical head for inserting through pilot holes 21 in an interference or frictional fit. Further, the pin can have a split extending longitudinally allowing pin 52 to be compressible. Aperture 54 is sized to frictionally receive 52 in a compressed condition but retains the pin 52 therein once it has passed therethrough. Other suitable locking fasteners, which are well known in the art, may also be used in the present invention.

In the preferred embodiment, corner brace 40 is molded as an integral unit from a plastic material.

Referring back to FIG. 1, the tote of the present invention can be assembled by folding the blank 12 in a manner well known in the art to present the sides of the tote. Once the blank 12 has been folded, pilot holes 21 align for receiving pins 52. Rails 28 and 30 are presented over the upper edge of the blank and the hand holds 26 are secured within the handle openings 24. The end panel 16 is bonded or spotwelded to the end flaps 20 to give the tote box 10 structural integrity. Corner braces 40 are placed over the corners of the tote box over the end regions of rails 28 and 30 to enclose the ends thereof.

Pin 52 is inserted through pilot holes 21 of end wall 16 and end flaps 20 to protrude through aperture 54 until the cone section passes therethrough and locks flap 50 to outer panel 42 below the rails. Once pin 52 has locked within aperture 54, inner member 44 will press against the rail which will clamp the wall within the channel of the rail.

The process is repeated for the other pin on the brace and then subsequently repeated for each corner brace. Once fully assembled, the horizontal portion 46 of corner brace 40 presents a surface upon which like tote boxes may be stacked. Lip 41 prevents the stacked totes from becoming sliding relative to a lower tote.

The approximate time to install the corner braces 40 of the present invention is estimated to be about 2 minutes or about a third of the time required to install the corner braces of the prior art. One reason is that the pin 52 does not pass through the rails and therefore the rails do not require holes to be drilled therethrough.

Figure 4:
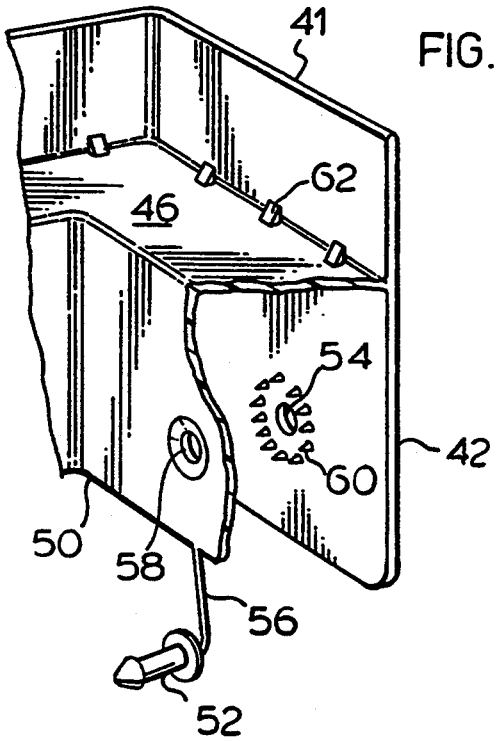
FIG. 4 is a perspective view of a second embodiment of the present invention.
Figure 5:
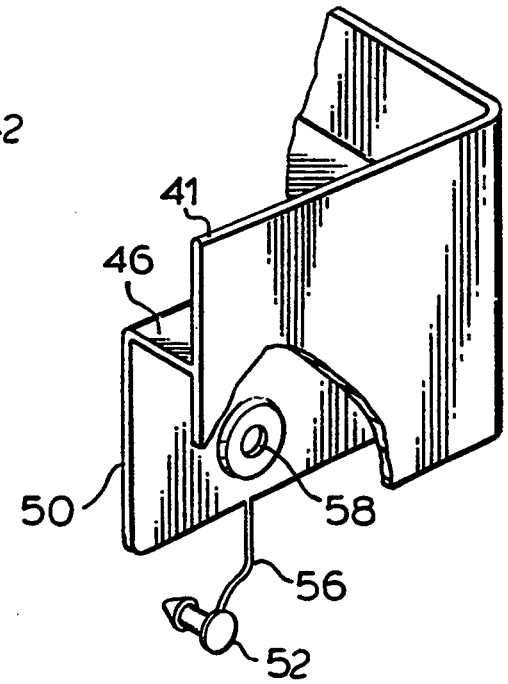
FIG. 5 is a rear perspective view of the embodiment of FIG. 4.

Referring to FIG. 4, a second embodiment of the locking pin is illustrated. Outer panel 42 is provided with projecting pins 60 surrounding aperture opening 54. Pin 52 is connected to a line 56 which joins the pin 52 to bottom flap 50. Bottom flap 50 is provided with an aperture 58 which aligns with aperture 54.

Optionally, angle braces 62 are molded between horizontal portion 46 and lips 41.

The tote box is assembled in the same manner as described with the first embodiment. However, pins 60 will penetrate wall 18 to more securely fasten corner brace to the walls.

Figure 6:
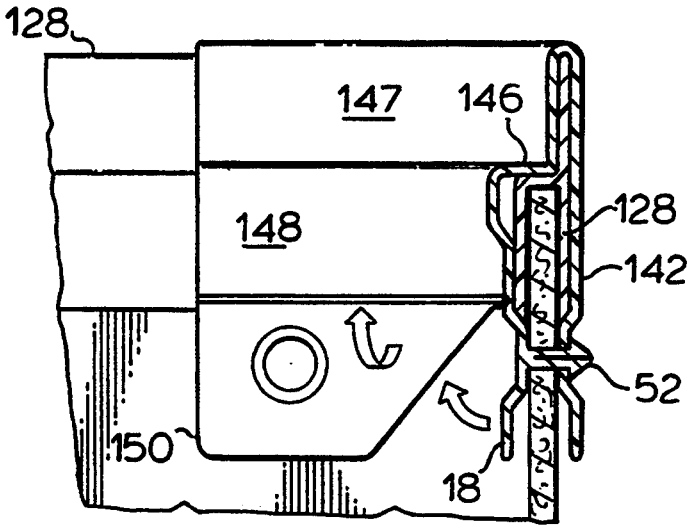
FIG. 6 is a perspective view of a second embodiment of the present invention for use with a raised rail.

Referring to FIG. 6, a second embodiment of the present invention is illustrated. This particular embodiment is used in association with an h-shaped rail 128 having a riser. Outer panel 142 extends upwardly and integrally joins with an inner member comprising an upper inner panel 147 which then extends horizontally to horizontal portion 146 which then extends downwardly and substantially vertically in panel 148 and then terminates lower most at lower flap 150. Pin 52 extends from lower flap 150.

Figure 7:
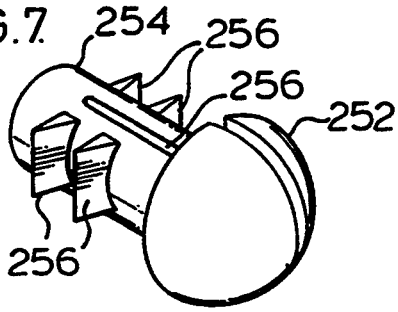
FIG. 7 is a perspective view of a third embodiment of the locking device of the present invention.
Figure 8:
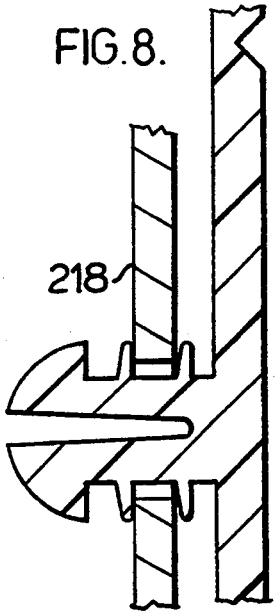
FIG. 8 is a sectional view of the locking device of FIG. 7 in a locked condition with a panel of the tote box.

Referring to FIGS. 7 and 8, a third embodiment of the locking pin is illustrated. The pin 252 has a conical head and a stem 254. The head and stem 254 has a slot 256 adapting the pin 252 to be compressible. Stem 254 has a plurality of fins 256 which are biased to permit insertion of the pin 252 into an aperture but prevents or inhibits removal. Once pin 252 is inserted through a pilot hole in panel 218, fins 256 lock the pin 252 thereto.

Figure 9:
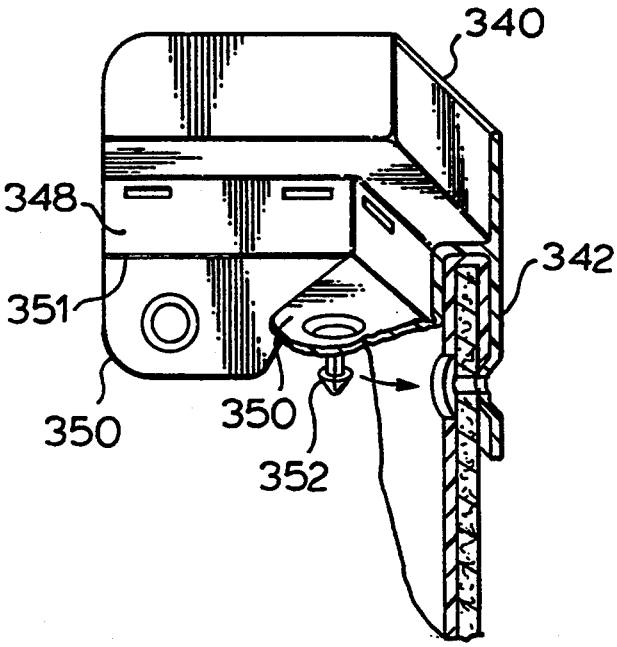
FIG. 9 is a perspective view of a third embodiment of the present invention.

Referring to FIG. 9, a second embodiment of the present invention is illustrated. Brace 340 is identical to the braces illustrated in FIGS. 2 and 6 except f that bottom flap 350 is hingedly connected to vertical portion 348 along hinge 351. As illustrated, flap 350 can pivot away from outer panel 342 to a locking position where pin 352 can penetrate a pilot hole and lock with outer panel 342.

Figure 10:
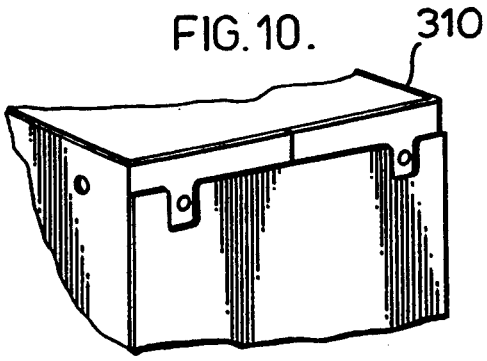
FIG. 10 is an outer perspective view of an end tote box assembly for the embodiment of FIG. 9.
Figure 11:
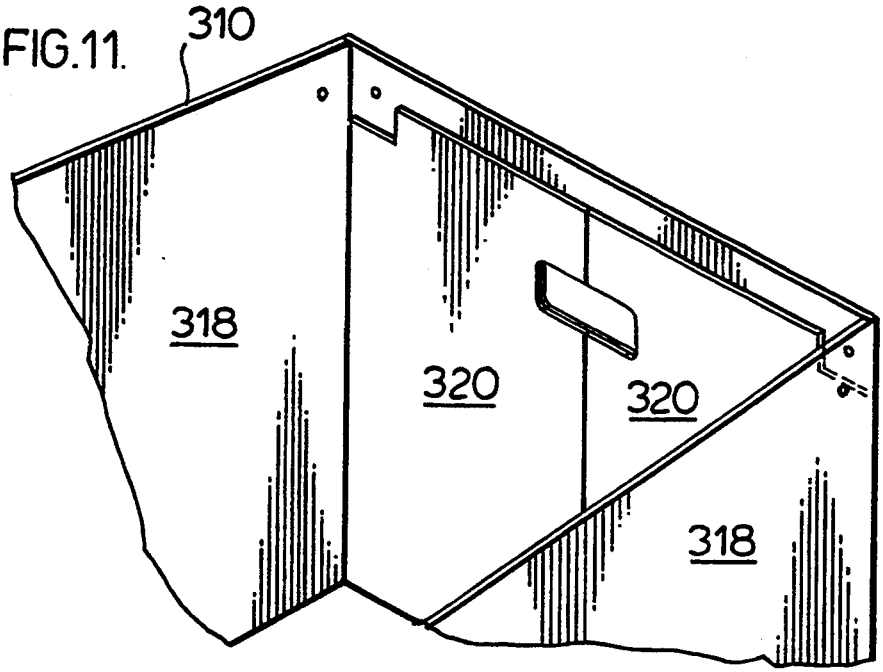
FIG. 11 is an inner perspective view of an end tote box assembly for the embodiment of FIG. 9.
Figure 12:
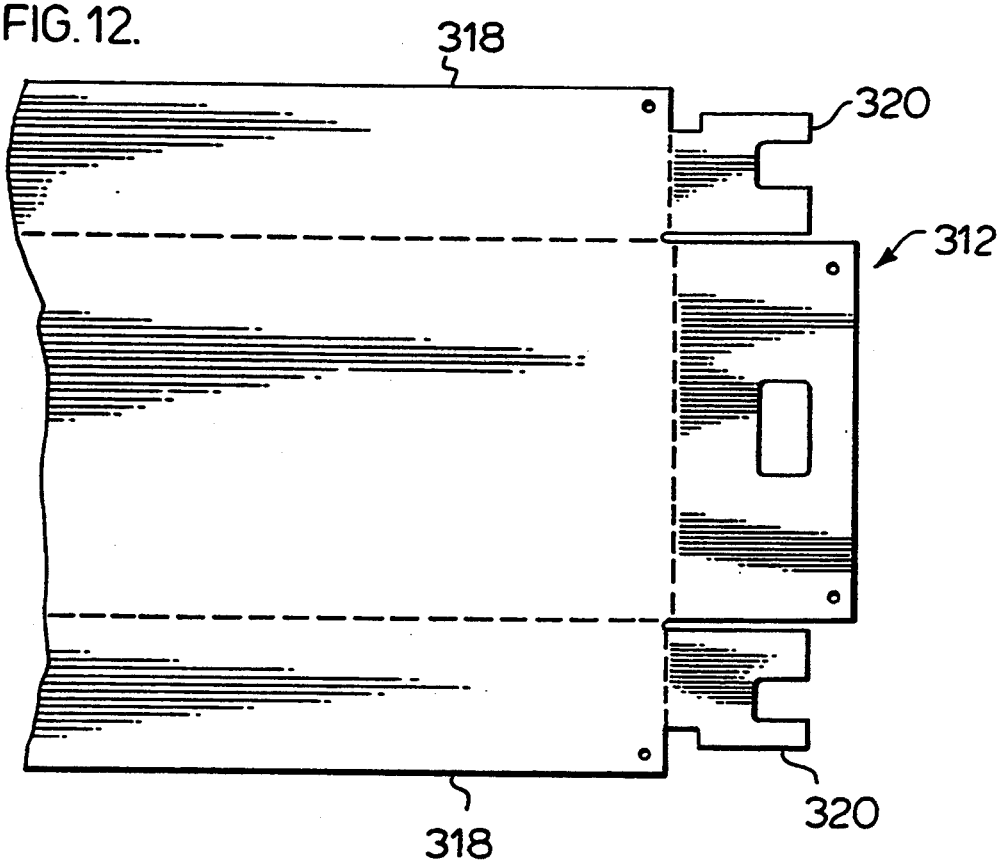
FIG. 12 is a top plan view of the end tote box assembly for the embodiment of FIG. 9.

Referring to FIGS. 10, 11 and 12, a tote box 310 is illustrated. In this embodiment, the either the end flaps 320 or the end panel is shortened, such that only one of either the end flaps or end panel are of the same height as the side panels 318. In this manner, the rails which are placed over the top edges of the tote box can have a uniform channel opening. In other words, since a single thickness of panel is presented along the top edges of the tote box, the same type of rail can be used for both the side edges and end edges. By removing the second layer of panel in the ends, the corner brace can be uniform and therefore eliminate the need for a left hand or right hand corner brace. A single corner brace will fit on either corner.

Figure 13:
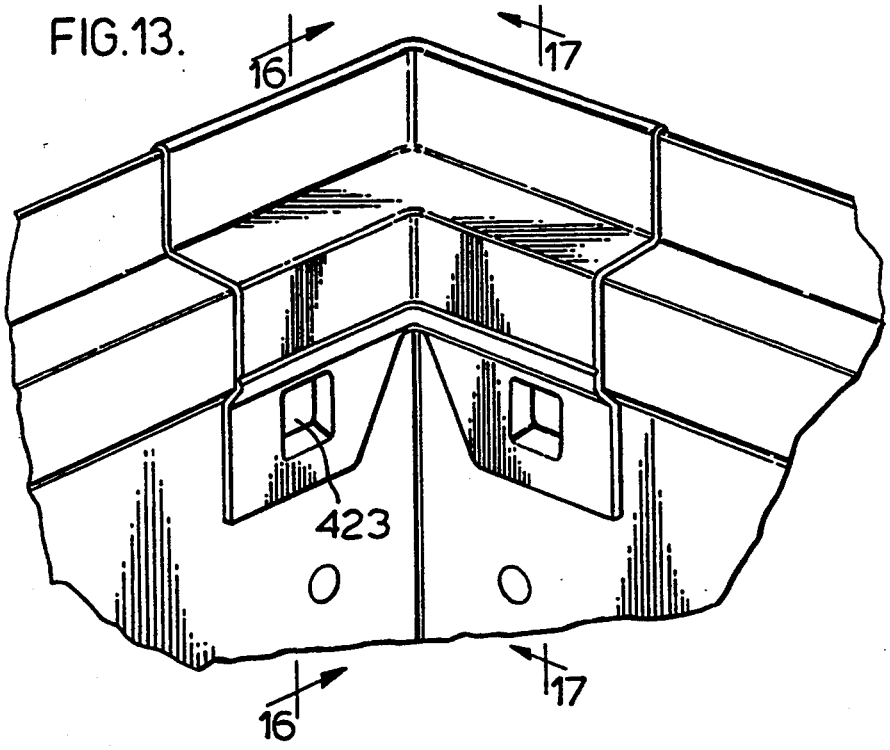
FIG. 13 is a perspective view of a third embodiment of the present invention.
Figure 14:
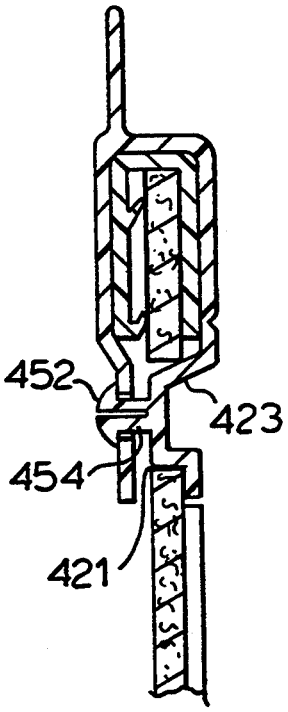
FIG. 14 is a side sectional view of the embodiment of FIG. 13 for use with a standard rail.
Figure 15:
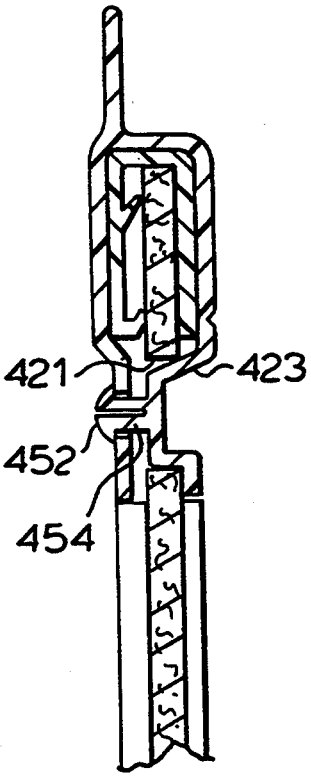
FIG. 15 is a side sectional view of the embodiment of FIG. 13 for use with a standard rail.

Referring to FIGS. 13, 14 and 15, a third embodiment of the present invention is illustrated. In this embodiment, the pilot holes 421 are rectangular in shape in order to receive a rectangular boss 423. Pin 452 is mounted on boss 423 for reducing the length of the stem 454 in comparison with the stems illustrated in FIGS. 2 and 7.

Figure 16:
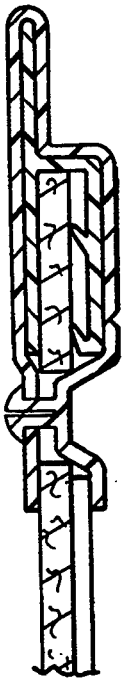
FIG. 16 is a side sectional view along the lines 16—16 of the embodiment of FIG. 13 for use with a rail having an h-shape section.
Figure 17:
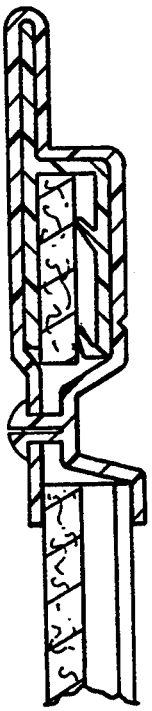
FIG. 17 is a side sectional view along the lines 17—17 of the embodiment of FIG. 13 for use with a rail having an h-shaped section.

Referring to FIGS. 16 and 17, the braces are illustrated as having an h-shaped cross section for extending over an h-shaped rail.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

I claim:

1. A corner brace for a tote box assembly, said tote box assembly comprising a box portion foldable from a box blank having a bottom, two side walls, two end walls and four end flaps extending from the side walls, said end walls and end flaps bonded together and having apertures into which are receivable hand holds, four rails each having a channel for complementarily fitting over a top edge of the tote box assembly in a folded condition, and four of said corner braces, each of said corner braces comprising, an outer panel for extending about a corner, an inner member integrally extending inwardly from said outer panel presenting a stackable surface, and a fastening means for fastening said corner braces to said side walls and end walls, wherein the improvement comprises said inner member sized to fit about and enclose an end region of said side rail and an end region of said end rail, said fastening means comprises a pin on one of said inner member or outer panel and an aperture lockably engaging said pin on the other of said inner member or outer panel, said pin having a first portion and a second portion defining a slit therealong and said fastening means joins said inner member to said outer panel through said walls and below said rails, clamping said rails and walls together.

2. A corner brace as claimed in claim 1 wherein said pin has a cone-shaped head.

3. A corner brace as claimed in claim 1 wherein said pin has a stem having a plurality of biased fins for lockably retaining a wall panel once the pin has passed therethrough.

4. A corner brace as claimed in claim 1 wherein said pin is compressible adapting said pin to penetrate said aperture in a compressed state and locking said pin therein in an uncompressed state.

5. A corner brace as claimed in claim 1 wherein said pin is connected to said one of said inner member or outer panel by a flexible attachment.

6. A corner brace as claimed in claim 1 wherein said inner member comprises a flap hingedly connected to said stackable surface.

7. A corner brace as claimed in claim 1 wherein said corner brace further comprises a lip integrally extending upwardly from said outer panel.

8. A tote box assembly comprising a box portion foldable from a box blank having a bottom, two side walls, two end walls and four end flaps extending from the side walls, said end walls and end flaps bonded together and having apertures into which are receivable hand holds, four rails each having an inverted channel for complementarily fitting over a top edge of the tote box assembly in a folded condition, and four corner braces, each of said corner braces comprising, an outer panel for extending about a corner, an inner member integrally extending inwardly from said outer panel presenting a stackable surface, and a fastening means for fastening said comer braces to said side walls and end walls, wherein the improvement comprises said inner member sized to fit about and enclose an end of said side rail and an end of said end rail, said fastening means comprises a pin on one of said inner member or outer panel and an aperture lockably engaging said pin on the other of said inner member or outer panel, said pin having a first portion and a second portion defining a slit therealong and said fastening means joins said inner member to said outer panel through said walls and below said rails, clamping said rails and walls together.

9. A corner brace for a tote box assembly, said tote box assembly comprising a box portion foldable from a box blank having a bottom, two side walls, two end walls and four end flaps each extending from the side wails, four extrusions each having an inverted channel for complementarily fitting over a top edge of the box portion in a folded condition, and four of said corner braces, wherein each of said corner braces comprises:

an integrally formed encapsulating member for extending over end regions of said extrusions, said encapsulating member having a plurality of flaps, at least two of which are foldable flaps hingedly connected to said encapsulating member, each foldable flap having a fastener to interlock with said encapsulating member about said extrusions clamping said extrusions and wails together.

10. A comer brace as claimed in claim 9 wherein each of said foldable flaps extends under the end regions of the extrusions for interlocking said encapsulating member.

11. A corner brace as claimed in claim 10 wherein each of said foldable flaps has a V-groove for hingedly connecting said foldable flaps to said encapsulating member.

12. A comer brace as claimed in claim 11 wherein each of said foldable flaps has a rivet adapted to interlock with said encapsulating member through said walls and end flaps of said box blank and below said extrusions.

13. A corner brace as claimed in claim 12 wherein said encapsulating member comprises an outer panel for extending about a corner, an inner member extending from said outer panel presenting a stackable surface, and said foldable flaps extending from said inner member.

* * * * *